US006014991A

United States Patent [19]

Teufel

[11] Patent Number: 6,014,991

[45] Date of Patent: Jan. 18, 2000

[54] METHOD OF MONITORING THE FUNCTION OF A STOP MOTION ARRANGEMENT IN AN AIR JET LOOM

[75] Inventor: Dieter Teufel, Langenargen, Germany

[73] Assignee: Lindauer Dornier Gesellschaft mbH, Lindau, Germany

[21] Appl. No.: 09/064,043

[22] Filed: Apr. 21, 1998

[30] Foreign Application Priority Data

Apr. 21, 1997 [DE] Germany ..... 197 16 587

[51] Int. Cl.[7] ..... D03D 51/34

[52] U.S. Cl. ..... 139/370.2; 340/677

[58] Field of Search ..... 139/370.2; 340/677; 364/470.15

[56] References Cited

U.S. PATENT DOCUMENTS

| | | | |
|---|---|---|---|
| 3,608,590 | 9/1971 | Hohener . | |
| 4,041,985 | 8/1977 | Gotoh . | |
| 4,270,579 | 6/1981 | Nakanishi | 139/370.2 |
| 4,362,190 | 12/1982 | Arakawa | 139/370.2 |
| 4,487,235 | 12/1984 | Sugita et al. . | |
| 4,527,598 | 7/1985 | Walch | 139/435.1 |
| 4,951,717 | 8/1990 | Riezler . | |
| 5,787,937 | 8/1998 | Teufel | 139/435.5 |
| 5,816,296 | 10/1998 | Schuster | 139/450 |

FOREIGN PATENT DOCUMENTS

| | | |
|---|---|---|
| 0004836 | 10/1979 | European Pat. Off. . |
| 0285872 | 10/1988 | European Pat. Off. . |
| 05033246 | 2/1993 | Japan . |
| 655745 | 5/1986 | Switzerland . |

*Primary Examiner*—Andy Falik
*Attorney, Agent, or Firm*—W. F. Fasse; W. G. Fasse

[57] ABSTRACT

In an air jet loom including a stop motion arrangement with first and second light beam sensor devices for detecting the presence of an inserted weft thread, the functionality of the sensor devices is continuously monitored. An inserted weft thread is expected to reach the first sensor device during an angular range (α1) of one rotation of the main shaft of the loom, whereupon the first sensor device emits a weft arrival signal (S1). In the event of a weft break, the weft thread reaches the second sensor device during the angular range (α1), whereupon the second sensor device emits a weft fault signal (S2). To monitor the functionality of the first sensor device, an interference signal (S3) emitted thereby during a second angular range (α2) not corresponding to the first angular range (α1) is evaluated. To monitor the functionality of the second sensor device, its light beam is positively interrupted by a projection (12') of a machine component (12) during each weft insertion cycle as the reed beats-up the inserted weft thread. Thus, the second sensor device positively emits a test signal during each reed beat-up at a time outside of the first angular range (α1). The presence, absence or irregularities of the signals (S3) and (S4) are statistically evaluated to determine whether a loom stop is necessary.

22 Claims, 2 Drawing Sheets

FIRST WEFT SENSOR

S1
S3
S4
0°
α1
α2
360°
MAIN SHAFT ROTATION
SIGNAL AMPLITUDE

SECOND WEFT SENSOR

S2
S4
0°
α1
α2
360°
MAIN SHAFT ROTATION
SIGNAL AMPLITUDE

METHOD OF MONITORING THE FUNCTION OF A STOP MOTION ARRANGEMENT IN AN AIR JET LOOM

PRIORITY CLAIM

This application is based on and claims the priority under 35 U.S.C. §119 of German Patent Application 197 16 587.7, filed on Apr. 21, 1997.

FIELD OF THE INVENTION

The invention relates to a method for monitoring the function of a stop motion arrangement including at least two weft sensors such as light beam sensor devices arranged at the outlet end of the weft thread insertion channel of a weaving reed in an air jet loom. The first weft sensor is adapted to detect a properly inserted weft thread, while the second sensor is adapted to detect a faulty insertion such as a weft thread break or an excessively long weft thread, and the detected conditions are transmitted as electrical signals to an evaluating unit.

BACKGROUND INFORMATION

It is generally known to equip an air jet loom with first and second light beam sensor devices at the outlet end of the weft insertion channel of the weaving reed, for monitoring the weft insertion and detecting any arising weft insertion faults. The second light beam sensor device is arranged slightly downstream or outwardly beside the first light beam sensor device. Thus, a properly inserted weft thread reaches and triggers the first light beam sensor device, but does not reach and trigger the second light beam sensor device. The sensor device emits a corresponding signal indicating that the weft thread has been properly inserted into the weft thread insertion channel of the weaving reed. However, in the event of a too-long weft thread or in the event of a weft break, the end of the weft thread will also reach the second light beam sensor device, such that the second sensor emits a corresponding electrical signal that will be evaluated in an evaluation unit to determine that a weft fault has occurred.

In some circumstances, one or both of the light beam sensor devices may fail to provide the proper weft detection signal, or may release an erroneous interference signal. As a result, a weft fault may fail to be detected, i.e. a signal apparently indicating a proper weft insertion may exist even though a weft fault has actually taken place. For example, during the weaving operation, the first light beam sensor device may release an interference signal that appears to be a weft detection signal. Such an interference signal may, for example, be caused by a break in the electrical cables connected to the light beam sensor device, such as the electrical cable providing power to the light beam source or the conductor carrying the detection signals. Such an interference signal may even arise during a phase of the weaving operation, i.e. in an angular position range of the main shaft of the loom, not corresponding to the angular range in the weft thread would be expected to reach the first light beam sensor device. The second light beam sensor device may also emit such an interference signal, which would appear to indicate that a weft fault has occurred, even if no weft fault has actually occurred.

On the other hand, a breakdown or failure of one or both light beam sensor devices, for example due to a cable break, may occur and go undetected. In this case, the evaluating unit may not receive signals indicating a weft fault that has actually occurred, or may receive erroneous signals apparently indicating a weft fault when a weft fault has not actually occurred. In conventional air jet looms using a stop motion including first and second light beam sensor devices located at the outlet end of the weft insertion channel, to the present day, there has been no reliable and unambiguous way to monitor the proper functionality or operability of the light beam sensor devices.

This problem exists especially with regard to the second sensor device. The first sensor device is expected to emit a weft detection signal for each properly completed weft insertion cycle. Thus, the operability of the first sensor device can be confirmed in each cycle. On the other hand, the second sensor device does not emit a weft detection signal in the normal operating condition with proper weft insertion cycles. The second sensor device only becomes active, i.e. emits a signal, rather infrequently and intermittently when a rare weft break takes place. Therefore, an inoperable second sensor may have the same signal output (e.g. no signal) as an operable second sensor indicating proper weft insertions. For this reason, it is generally not possible to detect a defect or failure of the operation of the second sensor device during each weft insertion cycle, and a failure of the second sensor device can go undetected for long periods of time, so that faulty weft threads may be woven into the cloth being produced.

Swiss Patent 655,745 discloses a method for detecting a weft insertion fault by using a weft detector arrangement provided on the loom. Such a weft detector arrangement is generally known as a stop motion, and this term will be used in the following discussion. For each rotation of the loom main shaft, the method according to Swiss Patent 655,745 defines a first rotational angular range during which a weft thread is expected to arrive at the stop motion sensors, and a second rotational angular range outside of the first range, i.e. during which a weft thread is not expected to arrive at the stop motion sensors. The stop motion arrangement monitors the presence of the weft thread during the above defined first and second rotational angular ranges. In this context, a signal indicating the presence of a properly inserted weft thread is only generated during the first rotational angular range, while a fault signal, which is not generated by a weft thread, is acquired in the second rotational angular range, and thereupon a signal which stops the loom operation is generated. The signal generated during the second rotational angular range is only evaluated as a fault signal after this signal arises continuously over a predetermined number of rotations of the loom main shaft, for example.

U.S. Pat. No. 4,487,235 (Sugita et al.) discloses a method and an apparatus for detecting a weft thread that has been inserted into the loom shed of a shuttleless jet loom, namely an air jet loom or a water jet loom. The method involves calculating a discriminating function for discriminating between the presence of the weft yarn and the presence of the jet of fluid under normal weft insertion conditions, as indicated by the signal produced by two weft sensors of a stop motion arrangement. A signal produced during actual weft detection operation is compared with the discriminating function by a statistical method to determine whether or not the weft yarn is present. The discriminating function may be based on or take into account the original wave-form of the signal, a differentiated value thereof, an integrated value thereof, frequencies in certain frequency ranges thereof, and sampling averages of the above parameters. The disclosed method and apparatus does not monitor the function of the individual weft thread sensors within the stop motion arrangement, and particularly does not monitor the function of the second or downstream weft sensor.

Published European Patent Application 0,004,836 discloses an apparatus for monitoring a weft thread using weft sensors or weft feelers in a fluid jet loom. The apparatus includes a generally conventional stop motion arrangement having first and second electrical weft sensors, which together sense and indicate a normally inserted weft thread, and having a further third weft sensor which detects a longer or broken weft thread. The apparatus and method do not provide for monitoring the functionality or operability of the individual sensors.

SUMMARY OF THE INVENTION

In view of the above it is an object of the invention to monitor, and preferably continuously monitor, the functionality of the light beam sensor devices of a stop motion arrangement provided at the outlet end of the weft thread insertion channel in a weaving reed of an air jet loom or other fluid jet loom, in order to reliably detect faults or defects in a weaving process and consequently to avoid the production of woven webs including faulty weft threads. The invention also aims to provide an apparatus for achieving the above mentioned objects in a structurally simple and reliable manner. The invention further aims to avoid or overcome the disadvantages of the prior art, and to achieve additional advantages, as apparent from the present description.

The above objects have been achieved in a method for continuously monitoring the functionality of light beam sensor devices of a stop motion arrangement provided at the outlet end of the weft insertion channel of a weaving reed of a fluid jet loom, and especially an air jet loom. The stop motion arrangement includes first and second light beam sensor devices arranged slightly spaced apart adjacent one another to carry out a detection as follows. A complete rotation of the main shaft of the loom includes a first rotational angular range $\alpha 1$ during which a correctly inserted weft thread would be expected to reach the first light beam sensor device and a faulty inserted weft thread would be expected to reach the second light beam sensor device. A complete rotation of the loom main shaft further includes a second angular range $\alpha 2$, which is distinct from the first range $\alpha 1$, and in which any arising signals are evaluated as electrical interference signals as will be explained below. According to the inventive method, if the first light beam sensor device senses the arrival of a correctly inserted weft thread during the first rotational angular range $\alpha 1$, then the first light beam sensor device releases an electrical signal S1 to an evaluation unit for indicating a correctly inserted weft thread. If the second light beam sensor senses the arrival of the weft thread during the first rotational angular range $\alpha 1$, then it releases an electrical signal S2 to the evaluating unit for indicating that a weft insertion fault has occurred.

In order to monitor the functionality of the second light sensor device, and optionally also the first light sensor device, the method further involves positively breaking or interrupting the light beam of the second light beam sensor device, and optionally also of the first light beam sensor device, at a time outside of the first rotational angular range $\alpha 1$. In this manner the second (and optionally the first) sensor device is positively triggered to release an electrical test signal S4 during each reed beat-up, whereupon the test signal may be monitored. In order to monitor the functionality of the first sensor device, the invention further involves evaluating interference signals S3 emitted by the first sensor device during the second rotational angular range $\alpha 2$, for example arising due to a break in the conductors leading to the light beam sensor device.

The absence of weft arrival signal S1, the presence of weft fault signal S2; the presence of interference signals S3, and/or the absence of test signal S4 are evaluated by the evaluating unit to determine whether a weft fault or an equipment failure of the stop motion arrangement has occurred, in which case the evaluating unit emits a stop signal to the loom control, which responsively stops the drive of the loon main shaft. More particularly, the interference signals S3 and the test signals S4 are first simply acquired and evaluated in the evaluating unit, without immediately signalling a loom stop. Namely, these interference signals S3 and the absence of the positively caused test signals S4 are acquired and statistically evaluated in the evaluating unit. Then, a loom stop signal S0 is only released after the interference signal S3 and the absence or deviation of the test signal S4 have been evaluated in accordance with an algorithm to determine the probability of the existence of an equipment failure of the light beam sensor devices and/or a defect or fault in the weaving process. The loom controller will then stop the drive of the loom main shaft and will indicate a failure warning, for example by an audible alarm or a visual display to warn the loom operating personnel. The probabilistic and statistical algorithm for analyzing the signals can be any known statistical or probabilistic comparison algorithm.

Preferably according to the invention, the light beam of the second light beam sensor device is broken, and thus the test signal S4 is positively generated during each reed beat-up, by a mechanical component of the loom that is located so as to break the light beam during the beat-up motion cycle of the reed. Particularly, the mechanical comoponent of the loom used for breaking the light beam is a protrusion or projection of a woven cloth support table of the loom.

An important feature of the invention is that not every single interference signal S3 arising during the angular range $\alpha 2$, or the absence of a signal within the angular range $\alpha 1$, immediately leads to a loom stop. Instead, more than one interference signal S3 or more than one occasion of the absence of an expected signal S1 can arise during several weft insertion cycles, while these signals or absence of signals are evaluated by means of an algorithm for determining the probability of a functional breakdown in the operation of the light beam sensor devices or a fault in the weaving process. Only when such an equipment failure or weaving fault is deemed probable, i.e. above a threshold probability, then the loom operation will be stopped.

Another important feature of the invention is that the functionality of the second light beam sensor device is positively monitored during each reed beat-up. The stop motion arrangement and the loom components are so arranged that the light beam of the second sensor device will be necessarily and positively interrupted during each reed beat-up thus when the weaving reed beats up the newly inserted weft thread against the beat-up edge of the woven web. In this manner, the second light device releases a test signal positively during each reed beat-up, even when no weft break or other weft fault exists. Therefore, the functionality of the second light beam sensor device can be monitored during each reed beat-up, and not only during the rare activation of the second sensor device in the event of a weft break or fault. It is particularly advantageous that the means for breaking the light beam simply comprise a protrusion or projection of a woven cloth support table, which is generally known from U.S. Pat. No. 4,951,717 (Riezler), the disclosure of which is incorporated herein by reference. As the reed completes the beat-up motion, the projection of the cloth expander table passes between the light source and the light detector of each light beam sensor device and thus breaks the light beam, generating the above mentioned test signal.

BRIEF DESCRIPTION OF THE DRAWINGS

In order that the invention may be clearly understood, it will now be described in connection with an example embodiment, with reference to the drawings, wherein.

DETAILED DESCRIPTION OF PREFERRED EXAMPLE EMBODIMENTS AND OF THE BEST MODE OF THE INVENTION

Figure 1:
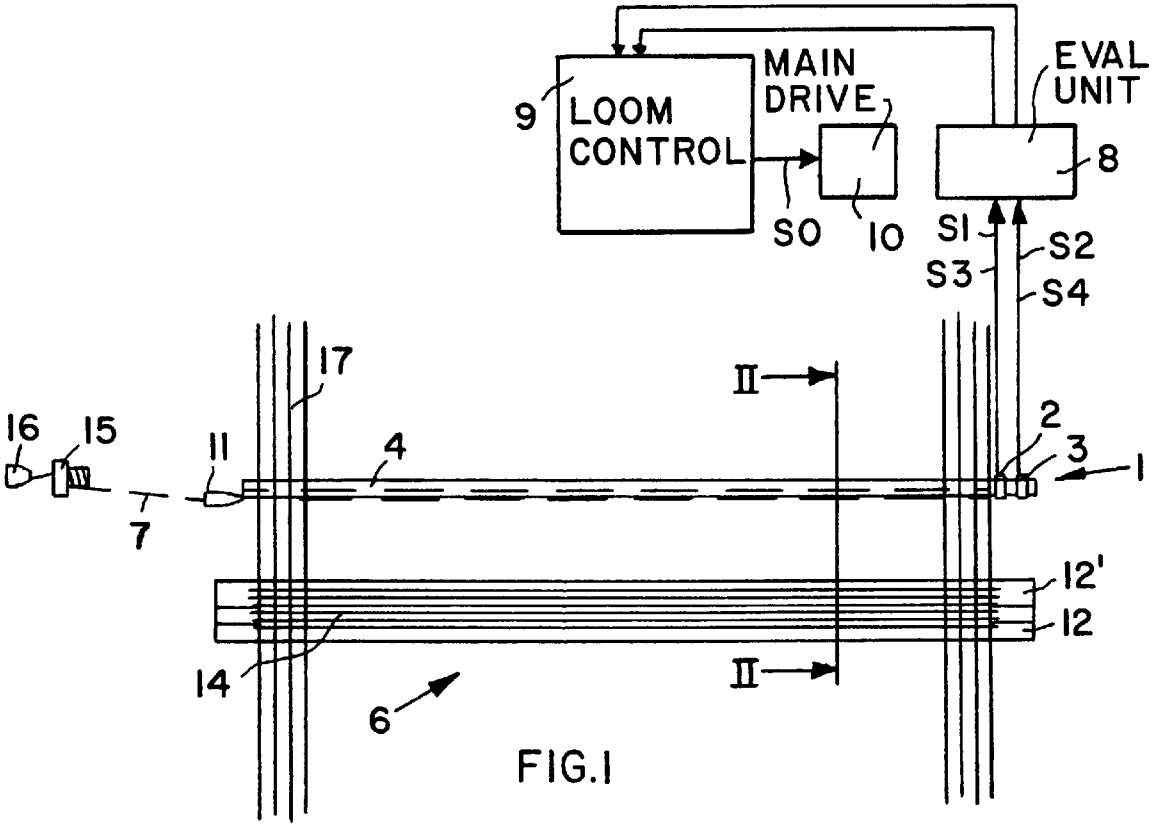
FIG. 1 is a schematic plan view of the significant elements of a loom incorporating the features for carrying out the method according to the invention.
Figure 2:
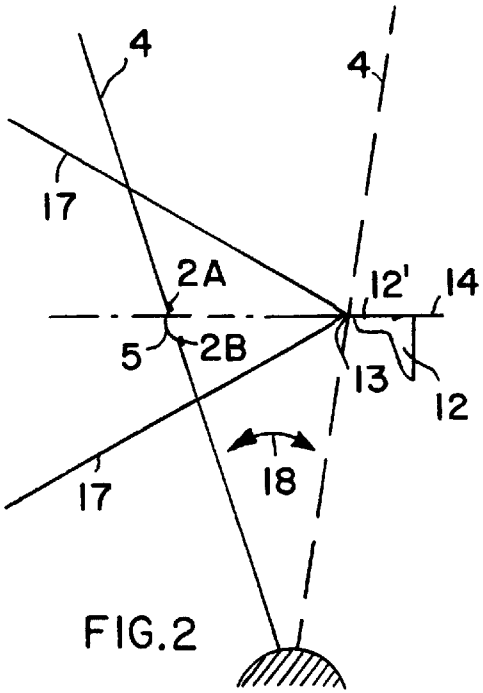
FIG. 2 is a schematic cross-section through the loom arrangement of FIG. 1, taken along the line II—II.

As shown schematically in the plan view of FIG. 1 and the sectional view of FIG. 2, a loom 6 includes a weaving reed 4 with a weft insertion channel 5 therein, and further includes a weft thread bobbin 16, a weft thread supply feeder 15, and a weft insertion nozzle 11 arranged at the upstream side of the reed 4, and further includes a stop motion arrangement 1 situated at the downstream side of the reed 4. The stop motion arrangement 1 includes a first light beam sensor device 2 and a second light beam sensor device 3 arranged adjacent one another, and slightly spaced apart, with the second light beam sensor device 3 slightly downstream of or outside of the first light beam sensor device in the weft insertion direction. Each one of the light beam sensor devices 2 and 3 includes a light beam source 2A, 3A and a light detector 2B, 3B. In FIG. 2, the second light beam sensor device 3 is not visible because it is behind the first light beam sensor device 2.

During normal weaving operation, the weft thread 7 provided from the bobbin 16 is accumulated and supplied from the weft thread supply feeder 15 to the insertion nozzle 11, which may be a water jet nozzle or an air jet nozzle, but is an air jet nozzle in the present example embodiment. The air jet nozzle 11 inserts the weft thread 7 through the insertion channel 5 of the reed 4. Upon its arrival at the first light beam sensor device 2, the free head end of the weft thread 7 breaks the light beam, so that the first light beam sensor device 2 detects the arrival of the thread and emits a corresponding electrical signal S1 to an evaluating unit 8.

A properly inserted weft thread 7 will not be long enough to reach the second light beam sensor device 3, so that in normal operation the second light beam sensor device 3 will not emit a signal to the evaluating unit 8. However, if a weft fault occurs, for example a weft break, then the broken weft thread will reach the second light beam sensor device 3, which accordingly emits a weft fault signal S2 to the evaluating unit 8. In another type of fault condition, for example a tangled weft thread, the weft thread will not reach even the first light beam sensor device 2, so that the light beam sensor device 2 will not emit a weft arrival signal S1 to the evaluating unit.

The evaluating unit 8 evaluates the signals it receives, as will be described in detail below, and provides corresponding evaluated signals to a loom controller 9, which in turn provides control signals, and particularly a loom stop signal S0 to the drive 10 for the main shaft of the loom. Thus, in the event that the evaluating unit a determines that a loom stop is necessary, the loom operation will be stopped by means of the loom stop signal S0.

The acquisition and evaluation of signals from the two light beam sensor devices is carried out with reference to prescribed angular ranges of the rotational angle of the main loom shaft in a complete single weaving cycle. A first angular range $\alpha 1$ is the range or time during which a properly inserted weft thread is expected to arrive at the first light beam sensor device, i.e. the angular range or time during which the first light beam sensor device is expected to release the weft arrival signal S1. A faulty weft thread would also be expected to reach the second sensor device 3 during the first angular range or time interval $\alpha 1$. A second angular range $\alpha 2$ is a range distinct from the range $\alpha 1$, i.e. in a time period in which the sensor devices are not expected to emit weft-triggered signals.

Figure 3A:
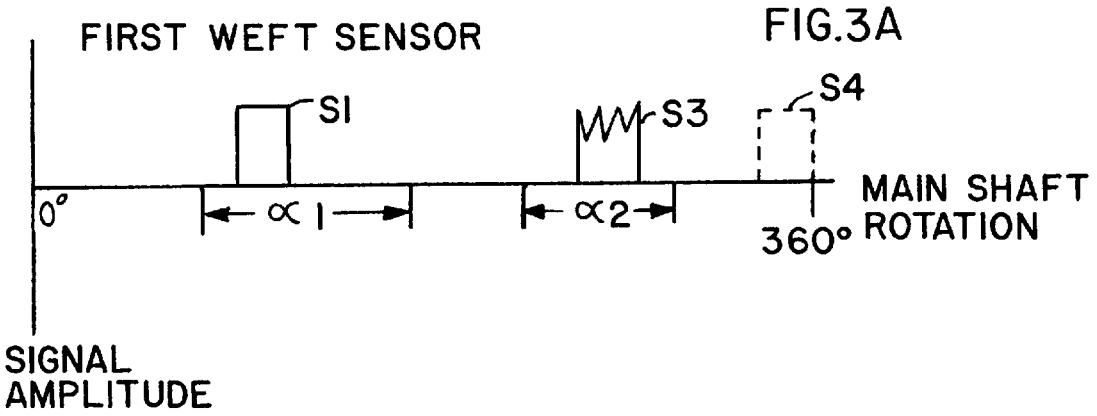
FIG. 3A is a schematic signal diagram of signals emitted by the first light beam sensor device during one weft insertion cycle.
Figure 3B:
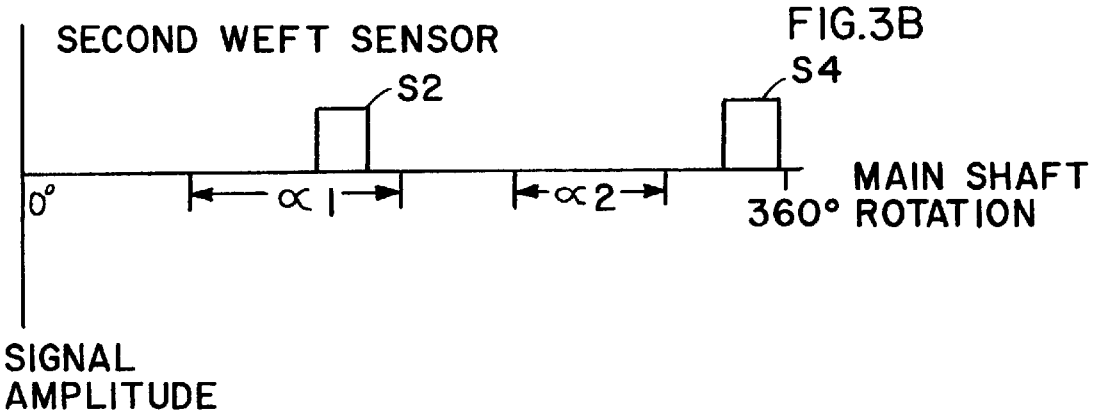
FIG. 3B is a schematic signal diagram of signals emitted by the second light beam sensor device during one weft insertion cycle.

The acquisition and evaluation of signals in relation to the angular position of the main loom shaft will now be described further with reference to FIGS. 3A and 3B, which are intended merely to show schematic example representations of waveforms for discussion and not actual waveforms. Signal acquisition of the normal weft arrival signal S1 by the first light beam sensor device 2 is carried out in the first angular range $\alpha 1$. In the normal situation, the first light beam sensor device 2 does not release any signals outside of the first angular range $\alpha 1$, because the weft thread 7 can only reach the first light beam sensor device 2 during the angular range $\alpha 1$. Thus, a signal emitted by the first light beam sensor device 2 during the angular range $\alpha 2$ is designated an interference signal S3, which is interpreted as resulting from an interference or defect in the light beam sensor device 2, for example a break in a conductor line leading to or from the light beam sensor device 2. Such an interference signal S3 occurring during the angular range $\alpha 2$ could be used directly to indicate the need for a loom stop. However, preferably according to the invention, the interference signal S3 is not used to trigger a loom stop immediately when it is released, but rather it is evaluated to monitor the operating functionality of the first sensor device in a manner that will be described below.

The first angular range $\alpha 1$ also includes the period during which a broken weft thread would be expected to reach the second light beam sensor device 3. Thus, the second light beam sensor device 3 will release the weft fault signal S2 to the evaluating unit 8 during the first angular range $\alpha 1$ in the event of a weft break or similar fault. When the evaluating unit 8 receives the weft fault signal S2 during the angular range $\alpha 1$, it triggers a loom stop of the drive 10 for the main shaft through the loom control 9.

During normal operation, when used in a conventional manner, the second light beam sensor device 3 would only be activated in the rather infrequent event of a weft break. Therefore, long periods of time may pass with the second light beam sensor device 3 not releasing any signal. If the light bear, sensor device fails or suffers a defect during such periods of inactivity, there would conventionally be no way of knowing that such an equipment failure had occurred. In other words, when used conventionally, the functionality of the second light beam sensor device cannot be monitored during each weaving cycle, unlike the first light beam sensor device.

As a result, in the conventional arrangement and method, a weft break will go undetected if the second light beam sensor device 3 failed during a period of inactivity, i.e. a period of properly inserted weft threads. In this case, the broken weft thread would trip the first light beam sensor device 2 so that it releases the weft arrival signal S1, but that signal S1 would not be overridden by the weft fault signal S2 because the second light beam sensor device 3 has failed or become inoperative. The equipment failure of the second light beam sensor device 3 will cause the weft break to be interpreted as a properly inserted weft thread because the evaluating unit will only receive the signal S1 without receiving the overriding fault signal S2. As a consequence, faulty weft threads will remain woven into the woven web that is being produced.

The invention avoids the above discussed problem of the prior art as follows. According to the invention, the functionality of the second light beam sensor device 3 can be continuously monitored during each weaving cycle by purposely and positively interrupting the light beam of the second light beam sensor device 3 during each reed beat-up at a time outside of the angular range $\alpha 1$. Thereby a test signal S4 is positively released by the second light beam sensor device 3 outside of the angular range $\alpha 1$ during each reed beat-up. The test signal S4 is recognized and evaluated by the evaluating unit 8 because it has a different signal characteristic and occurs during a different time interval than the faulty weft signal S2 that is released by the second light beam sensor device 3 during the angular range $\alpha 1$ in the event of a weft break. The light beam of the first light sensor device 2 may similarly be positively interrupted during each reed beat-up, so that the first light beam sensor device 2 also gives off a test signal S4' at a time outside of the angular range $\alpha 1$.

As shown especially in FIGS. 1 and 2, the invention provides a simple mechanical means for positively interrupting the light beam of the first and/or second light beam sensor devices as described above. To achieve this, the loom is equipped with a cloth supporting table or expander table 12 having a projection 12' that at least partially reaches into the weft insertion channel 5 when the reed 4 carries out its tilting beat-up motion 18 to beat the weft thread 7, which has been inserted into the open loom shed of warp threads 17, against the beat-up binding edge 13 of the woven web or cloth 14 that is being made. The cloth table 12 including the projection 12' is configured to extend laterally beyond the edge of the woven web 14, so that it extends into or overlaps the area at the end of the reed 4 at which the stop motion arrangement 1 is provided.

With this mechanical arrangement, as the reed 4 completes the beat-up motion, the projection 12' of the cloth table 12 reaches between the light beam source 3A and the light beam detector 3B of the light beam sensor device 3, and optionally also between the light beam source 2A and the light beam detector 2B of the light beam sensor device 2, so as to thereby interrupt the light beam and cause the light beam sensor device 3 and/or 2 to generate the corresponding signal S4, S4' at a time outside of the angular range $\alpha 1$. When this test signal S4, S4' (which is readily distinguishable from the signal S2) is received by the evaluating unit 8, it reliably indicates that the respective light beam sensor device is functioning properly.

In view of the above, the absence of a test signal S4 at a time outside of the angular range $\alpha 1$, the absence of a weft arrival signal S1 during the range $\alpha 1$, the presence of a faulty weft signal S2 during the angular range $\alpha 1$, and/or the presence or absence of interference signals S3 during the angular range $\alpha 2$, are evaluated by the evaluating unit 8 to determine whether a loom stop must be triggered. Generally, the presence of signal S2 or the absence of signal S1 can be evaluated immediately as requiring a loom stop, because these situations indicate that a weft fault has occurred during a weaving process. On the other hand, the signals S3 and S4 are to be evaluated, because these signals are generally indicative of a possible equipment failure or defect in the operation of the light beam sensor devices rather than a weft fault. Namely, the occurrence of signal S3 in the angular range $\alpha 2$ indicates that an interference has occurred in the first light beam sensor device 2 (while the absence of previously occurring interference may indicate the total failure of the first sensor device), and the lack of signal S4 at a time outside of the angular range $\alpha 1$ indicates that an equipment failure or defect has occurred in the second light beam sensor device 3.

In order to evaluate whether these situations are intermittent, temporary, or tangent anomalies on the one hand, or continuing equipment failure conditions on the other hand, the signals S3 and S4 are statistically evaluated in the evaluating unit 8 operating in connection with the loom control 9. This statistical evaluation is carried out by means of any known algorithm for determining the probability of the presence of a failure or an interference in the operation of the light beam sensor devices and/or a fault in carrying out the weaving process. This statistical evaluation may, for example, be carried out in accordance with a parameter evaluation and discrimination according to U.S. Pat. No. 4,487,235 (Sugita et al.), the entire disclosure of which is incorporated herein by reference. The evaluation may consider various characteristic parameters of the signals, such as the amplitude, frequency components, duration, etc., for example in comparison to stored values or to values derived from prior evaluation cycles. Once it is determined that a failure or fault which requires operator attention has probably occurred, i.e. its probability is greater than a threshold probability, then the loom controller 9 will signal a loom stop.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims. While the present invention has been described with reference to an air jet loom, the same method and apparatus features also apply to a water jet loom, wherein the light beam sensor devices can be replaced by a mechanical feeler sensor or an electrical sensor, and the projection 12' of the cloth table 12 is simply arranged to mechanically trip or trigger the corresponding mechanical or electrical sensor device.

What is claimed is:

1. A method of monitoring the function of a first weft sensor and a second weft sensor included in a stop motion arrangement provided in a fluid jet loom that is operated in successive weaving cycles, said method comprising the following steps in each respective one of said weaving cycles:

a) emitting a weft arrival signal (S1) from said first weft sensor to an evaluating unit if a respective inserted weft thread reaches said first weft sensor during a first time interval ($\alpha 1$);

b) emitting a weft fault signal (S2) from said second weft sensor to said evaluating unit if said respective inserted weft thread reaches said second weft sensor during said first time interval ($\alpha 1$);

c) emitting a respective test signal (S4) from at least said second weft sensor to said evaluating unit at a time outside of said first time interval if said at least said second weft sensor is functioning, by positively actuating said at least said second weft sensor at said time outside of said first time interval; and d) using said evaluating unit, evaluating whether said weft arrival signal (S1) has been emitted, whether said weft fault signal (S2) has been emitted, and whether said test signal (S4) has been emitted, and responsively to a result of said evaluating, either emitting a loom stop signal to a loom control for stopping a main drive of said loom or continuing said evaluating in a next successive one of said weaving cycles.

2. The method of claim 1, wherein said emitting of said loom stop signal in said step d) is carried out immediately if said evaluating determines that said weft arrival signal (S1) has not been emitted, or that said weft fault signal (S2) has been emitted.

3. The method of claim 2, further comprising emitting a weaving process fault signal together with said loom stop signal, for alerting a loom operator of a weaving process fault.

4. The method of claim 1, wherein said continuing of said evaluating in said next successive weaving cycle is carried out if said evaluating determines that said test signal (S4) has not been emitted.

5. The method of claim 4, wherein said evaluating in said step d) comprises statistically evaluating an absence of said test signal (S4) during a plurality of reed beat-up cycles in said successive weaving cycles, and wherein said emitting of said loom stop signal is carried out in said step d) if said statistical evaluating determines that a probability that said second weft sensor has failed exceeds a threshold probability.

6. The method of claim 5, further comprising an additional step including emitting an interference signal (S3) from said first weft sensor to said evaluating unit during a second time interval ($\alpha$2), and wherein said evaluating carried out by said evaluating unit further comprises another statistical evaluating of a presence or absence of said interference signal during said plurality of said a reed beat-up cycles, and wherein said emitting of said loom stop signal is carried out in said step d) if said another statistical evaluating determines that a probability that said first weft sensor has failed exceeds another threshold probability.

7. The method of claim 6, further comprising emitting an equipment failure signal for alerting a loom operator of an equipment failure in said stop motion arrangement.

8. The method of claim 6, wherein said second time interval ($\alpha$2) is distinct from said first time interval ($\alpha$1).

9. The method of claim 1, wherein said emitting of said loom stop signal is carried out immediately if said evaluating determines that said test signal (S4) has not been emitted.

10. The method of claim 1, further comprising continuing operating said loom in said weaving cycles if said evaluating in said step d) determines that said weft arrival signal (S1) has been emitted, said weft fault signal (S2) has not been emitted, and said test signal (S4) has been emitted.

11. The method of claim 1, further comprising an additional step including emitting an interference signal (S3) from said first weft sensor to said evaluating unit during a second time interval ($\alpha$2), and wherein said evaluating carried out by said evaluating unit further comprises statistically evaluating a presence or absence of said interference signal during a plurality of said successive weaving cycles, and wherein said emitting of said loom stop signal in said step d) is carried out if said statistical evaluating determines that a probability that said first weft sensor has failed exceeds a threshold probability.

12. The method of claim 11, wherein said statistical evaluating carried out by said evaluating unit further evaluates at least one characteristic parameter of said interference signal (S3).

13. The method of claim 1, wherein said fluid jet loom is an air jet loom, wherein said first and second weft sensors are respective first and second light beam sensor devices, and wherein said respective inserted weft thread breaks respective light beams of said first and second light beam sensor devices upon reaching said first and second light beam sensor devices respectively.

14. The method of claim 1, wherein said first time interval ($\alpha$1) corresponds to a first rotational angular range which is a portion of one complete rotation of a main drive shaft of said loom.

15. The method of claim 1, comprising emitting said test signal (S4) from only said second weft sensor and not said first weft sensor.

16. The method of claim 1, comprising respectively emitting said test signal (S4) from both said first weft sensor and said second weft sensor, and wherein said evaluating in said step d) comprises evaluating said respective test signal emitted respectively by said first weft sensor and by said second weft sensor.

17. The method of claim 1, wherein said positive actuating of said at least said second weft sensor comprises mechanically tripping said second weft sensor during each said weaving cycle.

18. The method of claim 17, wherein said second weft sensor is mounted on a reed of said loom, and wherein said mechanical tripping is carried out during each said weaving cycle at a time point of a reed beat-up when said reed beats said respective inserted weft thread against a beat-up edge of said weft that is being woven.

19. The method of claim 17, wherein said second weft sensor is a light beam sensor device, and wherein said mechanical tripping comprises moving a mechanical component that is fixed to a part of said loom, together with said part of said loom, in such a manner that said mechanical component selectively and positively interrupts a light beam of said light beam sensor device during each said reed beat-up.

20. The method of claim 19, wherein said part of said loom comprises a cloth support table, wherein said mechanical component comprises a projection extending from said cloth support table, and wherein said moving comprises moving said projection together with said cloth support table.

21. The method of claim 1, wherein all of said signals are respective electrical signals, and wherein said emitting steps respectively comprise generating and conducting said electrical signals.

22. In an improved air jet loom including a reed with a weft insertion channel therein, a weft insertion nozzle at an upstream end of said weft insertion channel, a stop motion at a downstream end of said weft insertion channel, and a cloth support table extending across a weaving width of said loom for supporting a cloth web being woven on said loom, wherein the improvement comprises an arrangement for monitoring a function of said stop motion, wherein said arrangement comprises a first light beam sensor device mounted on said reed adjacent said downstream end of said weft insertion channel, a second light beam sensor device mounted on said reed spaced downstream from said first light beam sensor device in a weft insertion direction, an evaluating unit, and respective signal conductors connecting said first and second light beam sensor devices with said evaluating unit, and wherein said cloth support table comprises a main support table and a projection that extends from said main support table into said weft insertion channel when said reed is in a weft beating-in position and that is configured to extend into a path of and interrupt a light beam generated by said second light beam sensor device when said reed is in said weft beating-in position.

* * * * *